US005096087A

United States Patent [19]

Thomas

[11] Patent Number: 5,096,087

[45] Date of Patent: Mar. 17, 1992

[54] DOUBLE CONTAINMENT AND LEAK DETECTION APPARATUS

[75] Inventor: Horace F. Thomas, Houston, Tex.

[73] Assignee: CoreTank, Inc., Houston, Tex.

[21] Appl. No.: 509,246

[22] Filed: Apr. 16, 1990

Related U.S. Application Data

[63] Continuation-in-part of Ser. No. 388,593, Aug. 2, 1989, Pat. No. 4,939,833.

[51] Int. Cl.[5] ..... G01M 3/00

[52] U.S. Cl. ..... 220/561; 220/4.12; 220/426; 220/445; 220/565; 220/627; 220/636; 220/661; 73/49.2; 137/312

[58] Field of Search ..... 220/565, 5 A, 626, 627, 220/661, 426, 445, 447, 466, 561, 4.12, 85 S, 400, 401, 403, 438, 441, 442, 628, 636, 638; 73/49.2; 137/312; 116/206, 266

[56] References Cited

U.S. PATENT DOCUMENTS

| | | | |
|---|---|---|---|
| 1,863,736 | 6/1932 | Willauer | 220/441 X |
| 1,927,255 | 9/1933 | Brown | 220/442 X |
| 2,050,686 | 8/1936 | Wiggins | 220/565 |
| 2,315,453 | 3/1943 | Pittman | 220/565 |
| 2,373,270 | 4/1945 | Skolnik | 220/565 X |
| 2,460,054 | 1/1949 | Wiggins | 220/565 |
| 3,149,742 | 9/1964 | Hay et al. | 220/424 X |
| 3,167,209 | 1/1965 | Jones | 220/403 X |
| 3,339,784 | 9/1967 | Filstead, Jr. | 220/445 |
| 3,547,301 | 12/1970 | Cambridge | 220/445 X |
| 3,762,175 | 10/1973 | Jones | 220/445 X |
| 3,902,356 | 9/1975 | Rupf-Bolz | 73/49.2 |
| 3,946,892 | 3/1976 | Rigal et al. | 220/445 |
| 4,023,617 | 5/1977 | Carlson et al. | 220/445 X |
| 4,068,777 | 1/1978 | Humphrey et al. | 220/565 |
| 4,648,523 | 3/1987 | Strock | 220/565 X |
| 4,651,893 | 3/1987 | Mooney | 220/445 |
| 4,744,137 | 5/1988 | Palazzo | 29/455 R |
| 4,916,939 | 4/1990 | Mögel | 73/49.2 |
| 4,939,833 | 7/1990 | Thomas | 29/401 |
| 4,960,222 | 10/1990 | Fields, III | 220/561 X |
| 5,002,195 | 3/1991 | Lasson | 220/4.12 |

*Primary Examiner*—Stephen Marcus
*Assistant Examiner*—Stephen Cronin
*Attorney, Agent, or Firm*—Harrison & Egbert

[57] ABSTRACT

A double containment and leak detection apparatus and method including a tank having a bottom and a surrounding shell, with a containment baffle above the bottom and a leak detector in a containment space between the containment baffle and the tank bottom. The containment baffle includes a baffle plate sealingly joined to the interior of the shell to form a sealed containment space between the containment baffle and the bottom. The leak detector is installed in the containment space to detect the presence of stored material held in the tank in the event such material leaks into the containment space. The leak detection means is connected, through a leak-proof access, to means external to the tank for responding to such leaks of stored material so detected inside the containment space. The invention further includes a primary containment, made of liner material, located inside the tank above the containment baffle and within the shell, capable of containing such stored material. A suitable flushing mechanism is provided so as to remove any leaked fluids from the containment space.

10 Claims, 4 Drawing Sheets

DOUBLE CONTAINMENT AND LEAK DETECTION APPARATUS

RELATED APPLICATIONS

The present invention is a continuation-in-part application of U.S. patent application Ser. No. 07/388,593, filed on Aug. 2, 1989, now U.S. Pat. No. 4,939,833, and entitled "Double Containment and Leak Detection Apparatus". This application is presently pending.

BACKGROUND OF THE INVENTION

The present invention relates to means for containing and detecting leaks in storage tanks. More particularly, the present invention relates to apparatus and methods for constructing such apparatus, for containing multiple or repeated leaks of hazardous, polluting, or otherwise undesirable fluids or solids from storage tanks, and for quickly detecting and signaling the presence of such leaks, thereby minimizing the dangers posed by storing such fluids and solids and complying with regulations requiring such containment and detection.

Storage of hazardous liquids and solids used in numerous industries requires storage tanks of all sizes. Chemical process plants, refineries, oil and gas production sites, manufacturing plants, and the like require storage of a variety of materials for processes used in such facilities. The materials so stored, whether gases, liquids or solids, may include chemicals and compounds that could endanger the environment or pose significant health risks in the event of leakage into areas surrounding these storage systems. Heightened awareness in recent years over the quality of the environment has increased and tightened the rules, regulations, and requirements governing storage of such materials. Growing concern with public health issues has further emphasized the need to prevent leakage of hazardous materials into the environment to prevent, for instance, contaminating drinking water or exposing humans or wildlife to hazardous compounds.

Among the regulating governing the storage discussed above, by way of example, are the rules promulgated by the Environmental Protection Agency ("EPA") for hazardous waste management systems. See, e.g., 40 C.F.R. §§260–65 and §268 (1988). The EPA rules govern, among other matters, tank systems that store hazardous wastes. Id., §260.10. Hazardous wastes subject to these regulations include a host of residues, byproducts, and wastes that are generated or used in any of a lengthy list of chemical, manufacturing, and other processes. Id., §§261.3–ff. Under these regulations, what is designated "secondary containment" must be provided on all new tank systems storing hazardous wastes, and on existing hazardous waste systems as of various effective dates subsequent to Jan. 12, 1987. See id., §264.193 and §265.193. Such a secondary containment system must permit spilled or leaked waste to be removed from that secondary containment system within twenty-four (24) hours after a spill or leak. Id. Furthermore, the EPA regulations deem a tank system "unfit for use" if it is no longer capable of storing or treating hazardous wastes without itself posing a threat of release of hazardous waste to the environment. Id., §260.10. Finally, the EPA regulations require that any hazardous waste materials released into a secondary containment system must be removed within twenty-four (24) hours, or in as timely a manner as is possible. Id., §264.196. The tank system the released waste is removed and any necessary repairs to the system are made. (Although reference is made in the present application to EPA regulations and the definitions used in those regulations, those definitions are not intended to, and do not, generally govern the use of terms in this application. Except as may be expressly noted to the contrary, all terms used in this application are to have their common and accepted meanings.)

Therefore, an acceptable secondary containment system under these EPA regulations must, in general terms, be capable of collecting and accumulating liquids that leak from a tank, detecting such a leak or the presence of the accumulated liquids in the system, and permitting removal of such liquids, all within twenty-four (24) hours of the leak. Id. As can be seen, therefore, the EPA regulations, as well as increasing safety and health concerns, have imposed stringent requirements for containing, detecting, and removing leakage of hazardous materials from storage tank systems. Effective, economical, and safe double containment and leak detection systems, therefore, are not only desirable but also mandatory, both for new and existing tank systems.

The cost of building new systems or converting old systems to comply with the EPA regulations could be astronomical if not performed with a minimum of alteration to tank systems built under previous requirements. Prior attempts at meeting the EPA regulations have encountered problems and proven unsatisfactory, for a variety of reasons. For example, various plastic liners, both internal and external, have been used in trying to meet the secondary containment requirement of the EPA regulations. Such liners, however, have split at their seams and would lead to contamination of the soil in the event of external tank leaks. To meet the requirements for removal of wastes, the contaminated soil then has to be removed and disposed of, which requires either removing the tank bottom or lifting the entire tank, to permit digging up the soil. This process of lifting or dismantling the tank and removing soil (which generally needs to be replaced) is very expensive and time-consuming. Another unsuccessful attempt to meet the EPA secondary containment regulations has utilized double-walled and double-bottom tanks, generally made of steel, with the annular space between the walls and bottoms filled with sand or other filler material. This latter technique has also proven to be unacceptable, because it fails to allow for removing, cleaning, and disposing the filler material should a leak occur.

It can be seen, therefore, that a need exists for meeting EPA regulations and satisfying environmental and safety concerns in general by providing economical, effective, and reliable double containment and leak detection systems for storage tanks, for both new and existing storage tank systems.

SUMMARY OF THE INVENTION

Accordingly, the present invention is directed to providing a means for double containment and leak detection that effectively and inexpensively satisfies EPA regulations and provides superior and safe control and detection of leaks from storage tanks. The present invention enables effective yet relatively inexpensive conversion of new or existing storage tanks to provide a secondary containment system that permits containing, accumulating, and detecting the presence of fluids or solids that might leak from the primary containment space in such tanks into a containment space provided by the present invention.

The invention provides an apparatus including a tank, having a bottom and a surrounding shell, with the addition of a containment baffle means above the bottom and a leak detection means in a containment space between the containment baffle means and the tank bottom. (Most external corrosion failures in tanks occur at the tank base, which is generally inaccessible for inspection and subject to the greatest hydrostatic pressure.) The containment baffle means includes a baffle plate sealingly joined to the interior of the shell to form a sealed containment space between the containment baffle and the bottom. The present invention permits ready flushing and cleaning of the containment space to allow removal of waste material and restoration of the apparatus to its pre-leakage condition. The present invention further provides for installing the leak detection means in the containment space to detect the presence of the stored material in the event it leaks into the containment space. The leak detection means is connected, through a leak-proof access, to means external to the tank for responding to such leaks of material so detected inside the containment space. The invention further includes a primary containment means, made of liner material, located inside the tank above the containment baffle means and within the shell, capable of containing such stored material. The invention further provides a method for converting existing tanks simply and inexpensively to incorporate the double containment and leak detection apparatus of the present invention into existing facilities.

These and various other characteristics and advantages of the present invention will become readily apparent to those skilled in the art upon reading the following detailed description and claims and by referring to the accompanying drawings.

BRIEF DESCRIPTION OF THE DRAWINGS

For a more detailed description of the preferred embodiment of the invention, reference is now made to the accompanying drawings, wherein.

DESCRIPTION OF THE PREFERRED EMBODIMENT

Modern chemical and manufacturing processes require storage of a variety of hazardous, dangerous, or otherwise undesirable materials. Concern for protection of the environment, awareness of health risks, and increasingly stringent regulations and laws dictate a need for improved protection against accidental or uncontrolled leakage of such materials from storage. In particular, Environmental Protection Agency regulations require that all storage systems, both new and existing, have or soon be equipped with secondary containment systems that are capable of collecting, accumulating, and detecting leakage of hazardous wastes from the primary containment system. Storage systems must also permit removal of hazardous waste material that leaks or spills into the secondary containment system, so the entire system can be restored to the original condition that existed before such leak or spill. The present invention, an embodiment of which is described below, is intended to provide apparatus for achieving such containment and detection of leaks from storage tank systems.

Figure 1:
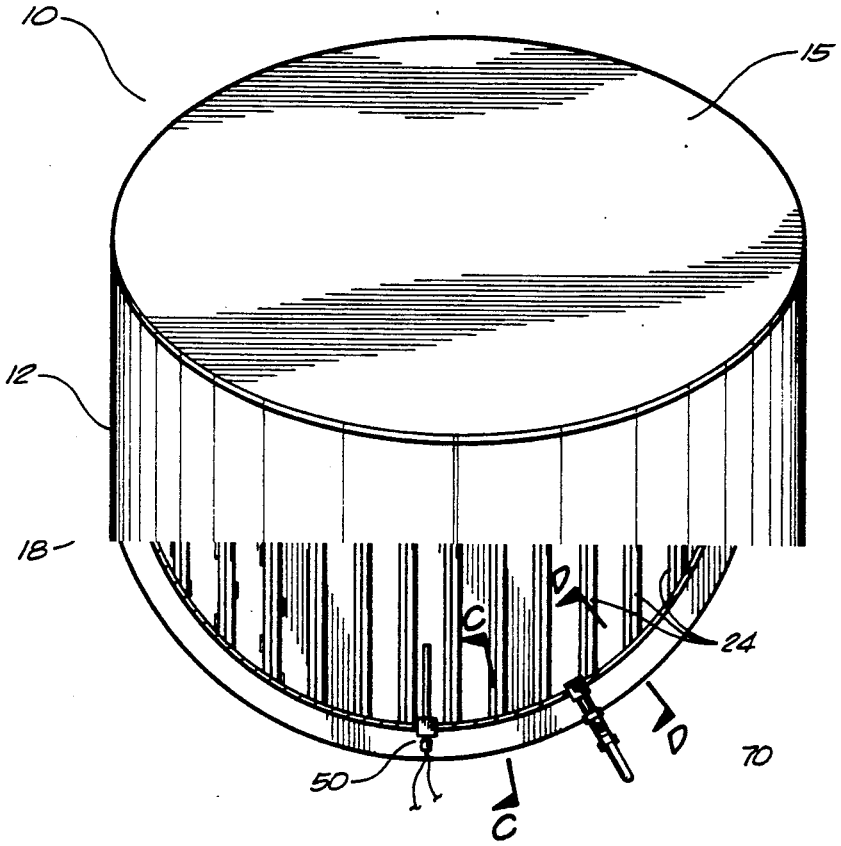
FIG. 1 shows an overall perspective view of a storage tank built in accordance with, and utilizing, the principles of the present invention (with various details omitted for clarity)

With reference to FIG. 1, there is shown therein a tank system 10 utilizing a double containment and leak detection apparatus built according to the present invention. The tank system 10 includes a tank body 11 having a shell 12 extending above a bottom 14. The shell 12 and bottom 14 are sealingly connected to form a container for storing, by way of example, liquids, in the embodiment shown. The present invention also is suitable for use on tanks for storing gases or solids, as the case may be. In the embodiment shown in FIG. 1, the tank system 10 includes a top 15 for covering the interior of the tank body 11. It is also within the scope of the invention to utilize a tank system 10 that lacks such a top 15, with containment and detection of leaks from the lower portions of the tank system 10.

Figure 2:
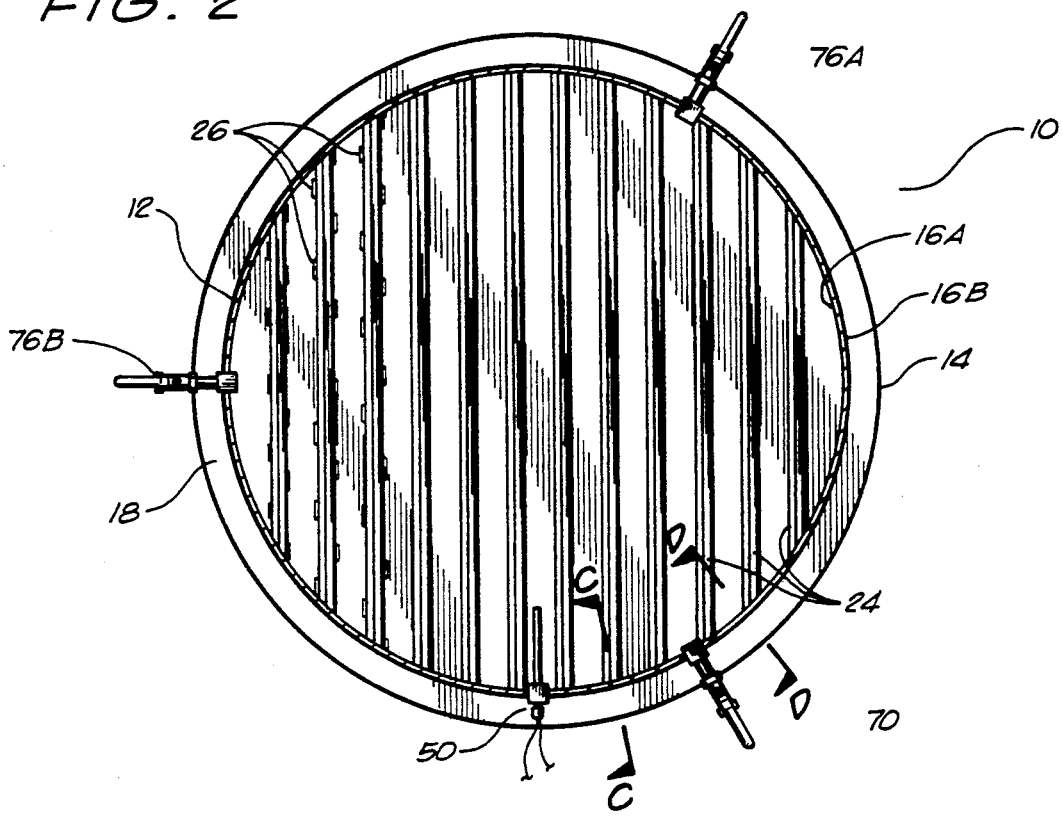
FIG. 2 shows a cross-sectional plan view of the tank shown in FIG. 1, viewed along the line A—A of FIG. 1.
Figure 3:
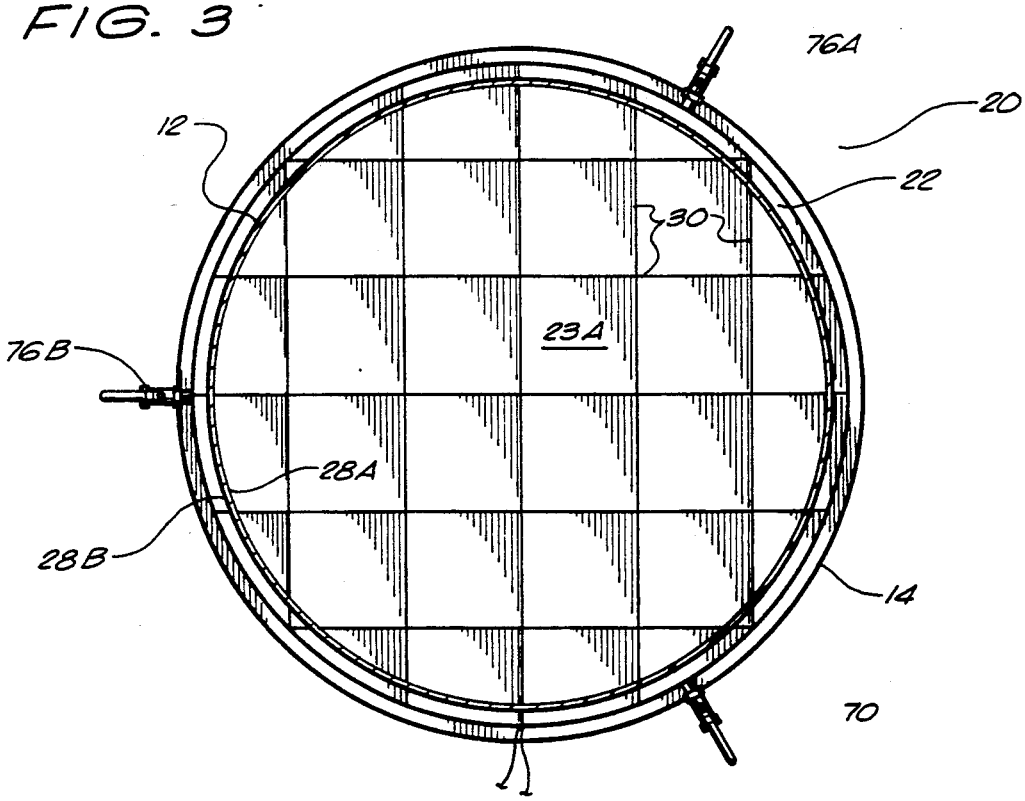

Referring now to FIG. 2, there is shown therein a cross-sectional plan view along line A—A of FIG. 1, depicting various details omitted for clarity from FIG. 1. As can be seen in FIG. 2, the shell 12 is generally circular in cross-section, although another appropriate shape would be suitable for purposes of the present invention. The base of the shell 12 in the depicted embodiment rests on the upper surface 18 of the bottom 14. The junction between the shell 12 and the bottom 14 is sealed on the interior and exterior periphery by an interior weld 16A and a bottom exterior weld 16B, respectively, both of which are full-penetration welds and are shown in more detail in FIGS. 5 and 6, described below. With the shell 12 thus in continuous sealing contact with the bottom 14, the tank body 11 can hold materials within its interior. (Other elements depicted in FIG. 2 are discussed in more detail below.)

Figure 3:
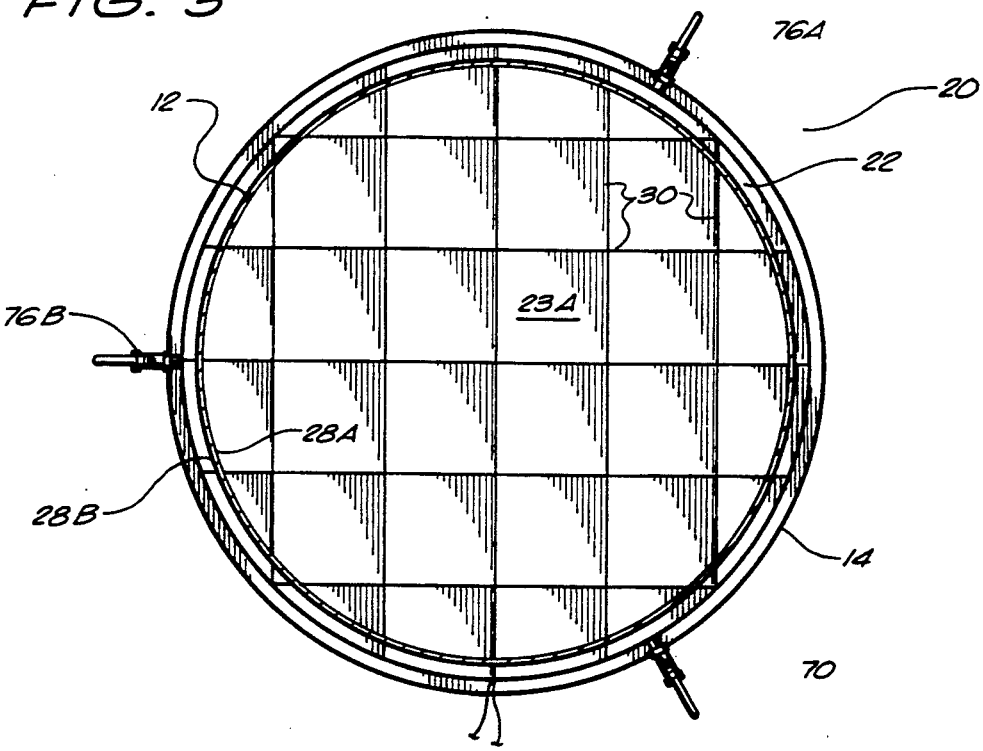
FIG. 3 shows a cross-sectional plan view of the tank shown in FIG. 1 viewed along the line B—B of FIG. 1.
Figure 5:
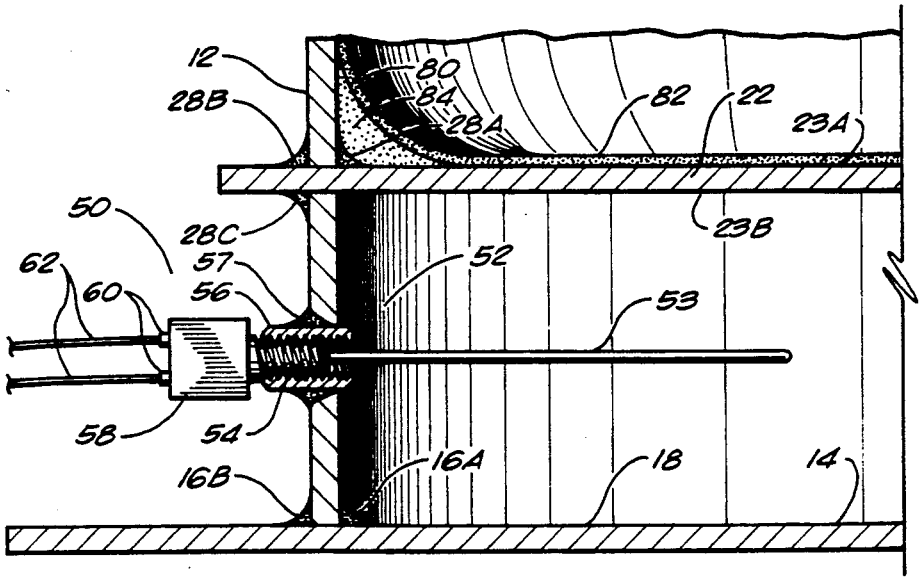
FIG. 5 shows a partial cross-sectional elevational view of a portion of the tank of FIG. 2, taken along line C—C in FIG. 2.
Figure 6:
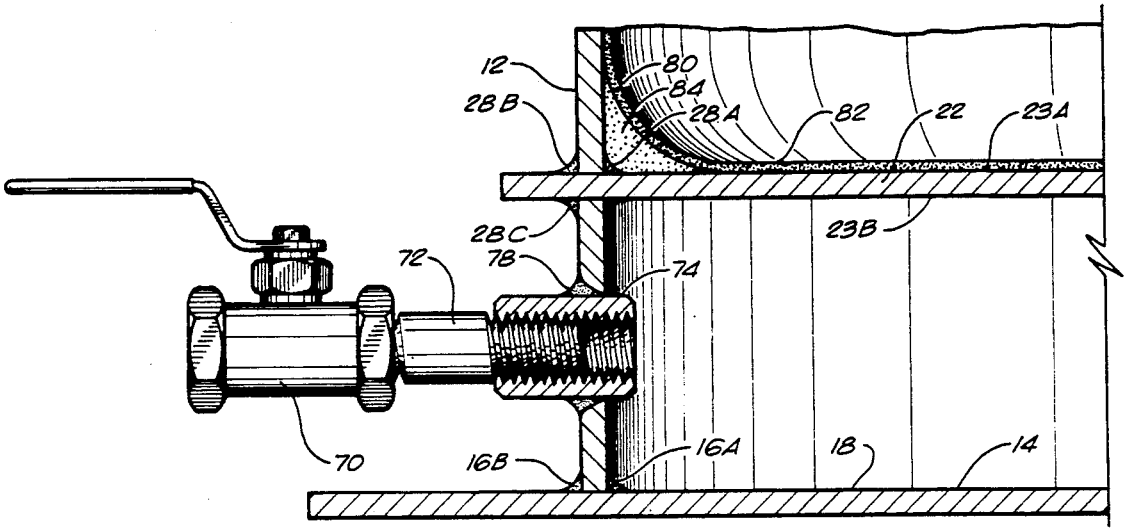
FIG. 6 shows a partial cross-sectional elevational view of a portion of the tank of FIG. 2, taken along the line D—D of FIG. 2.

With reference now to FIG. 3, there is shown therein a cross-sectional plan view taken through line B—B of FIG. 1, in which elements of the containment baffle means 20 of the present invention are shown. The shell 12, shown in cross-section, is generally perpendicular to and extends above a baffle plate 22, which is above and substantially parallel to the bottom 14, and has upper and lower surfaces 23A and 23B, respectively. The baffle plate 22 is in continuous sealing contact with the interior surface of the shell 12 by means of a baffle interior weld 28A disposed about the interior periphery of the shell 12 where it meets the baffle plate 22. In the embodiment shown, the baffle plate 22 extends outside the exterior of the shell 12, although such arrangement is not necessary for purposes of the present invention. (As discussed below, the embodiment depicted herein envisions insertion of the baffle plate 22 into an existing tank body 11, which is facilitated by the particular construction of the baffle plate 22 shown.) In the embodiment depicted in FIG. 3, the baffle plate 22 is actually constructed from smaller plates joined together into one larger plate by means of interconnecting lap welds 30, some of which are depicted in FIG. 3. To ensure structural integrity and sealing contact, the baffle plate 22 is joined to the exterior of the shell 12 by welds between the exterior of the shell 12 and the portion of the baffle plate 22 extending outside the shell 12. Upper baffle exterior weld 28B, on the upper surface 23A of baffle plate 22, is shown in FIG. 3; lower baffle exterior weld 28C, on the lower surface 23B of baffle plate 22, and upper baffle exterior weld 28B are depicted in FIGS. 5 and 6, discussed below.

With reference again to FIG. 2, the embodiment described herein includes baffle supports 24 depending upon and fastened to the upper surface 18 of bottom 14 of the tank system 10. These baffle supports 24 provide structural support for the baffle plate 22 shown in FIG. 3. The baffle supports 24 are spaced apart, with gaps between adjacent baffle supports 24, to permit flow around each baffle support 24 and thereby to facilitate cleaning and flushing of the space, designated the containment space, that is located above the upper surface 18 of the bottom 14 and below the baffle plate 22. (Such cleaning and flushing is described in more detail below.) In FIG. 2, the baffle supports 24 are depicted as comprising numerous individual segments of baffle supports 24 disposed, with gaps between adjacent baffle supports 24, on the upper surface of the bottom 14.

Figure 4:
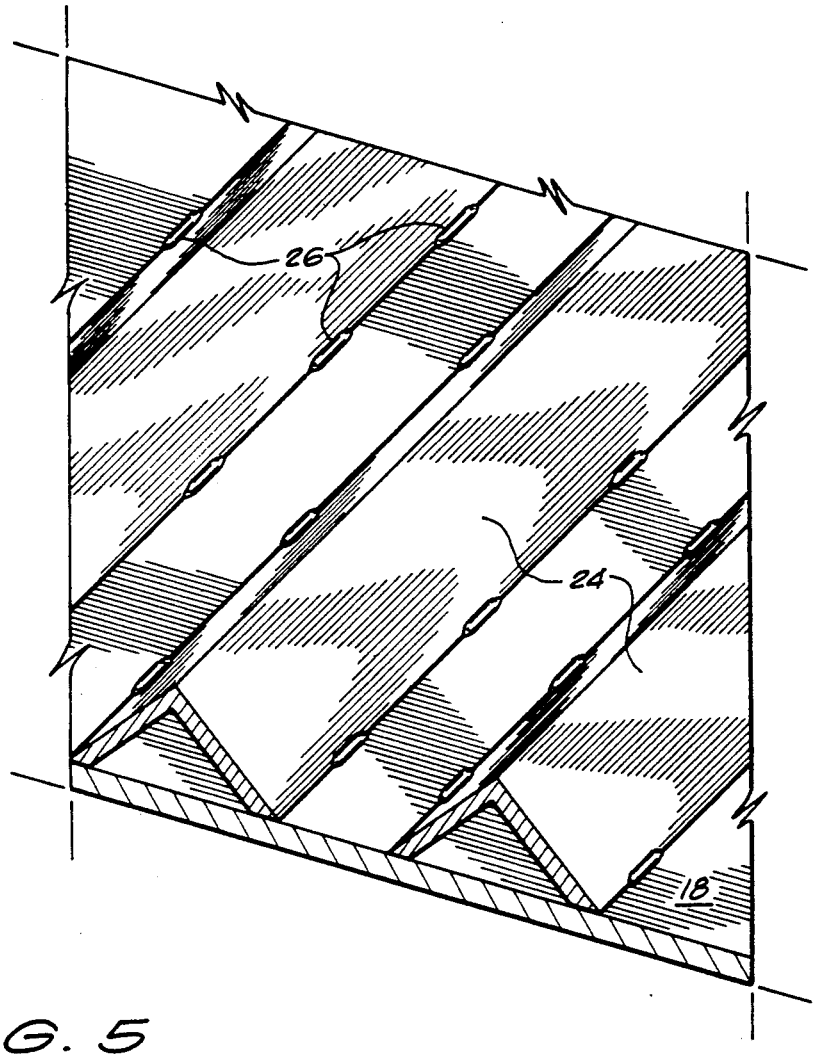
FIG. 4 shows a detailed perspective of a portion of the view of the tank shown in FIG. 2.

FIG. 4, which depicts a perspective view of a baffle support 24 on the upper surface 18 of the bottom 14 of the tank body 11, provides additional detail of the baffle support 24. By way of example only, an acceptable baffle support 24 for a variety of applications is a 3-inch by 3-inch by ¼-inch thick steel structural member placed in an inverted position, as shown in FIG. 4, on the upper surface 18 of the bottom 14. As shown in FIG. 2, each baffle support 24 sits on the upper surface 18 of the bottom 14 with opposite ends of each support 24 located adjacent to points on the interior periphery of the shell 12. In addition, a plurality of support welds 26 of appropriate size and at appropriate intervals along the juncture of each side of the baffle support 24 and the upper surface 18 of the bottom 14, as shown in FIGS. 2 and 4, fasten each baffle support 24 to the upper surface 18. It has been found that, for a variety of applications, support welds 26 in the form of fillet welds, each approximately 1-inch long, spaced at intervals of four feet on center along the length of baffle support 24 will be generally adequate to secure the baffle supports 24 during construction and thereby meet the purposes of the present invention. The precise spacing of such support welds 26, however, is not critical to the present invention, and appropriate spacing can be determined by those skilled in the art.

The desired length of each baffle support 24 and spacing between adjacent baffle supports 24 will, in each individual case, be subject to the anticipated loading that the baffle plate 22 will have to support. The anticipated loading can be calculated based on the materials to be stored, the dimensions of the tank system 10, the dimensions and structural characteristics of the baffle plate 22, and applicable design codes and requirements. Given such information, the required spacing and lengths of the baffle supports 24 can then be determined.

In addition, although inverted angle structural members are depicted for the embodiment described herein, a variety of other structural members or shapes can be provided as necessary support for the baffle plate 22. A variety of techniques and materials (such as flat bars, I-beams, rebars, grating, etc.) can be used to provide adequate structural support for the baffle plate 22. It is important that the baffle plate 22 be supported sufficiently to bear the weight of the materials to be stored within the tank body 11 without undue or impermissible stress or deflection. In certain instances, for example, the baffle plate 22 might be of sufficient structural strength to eliminate the need for any baffle supports 24.

In addition, each baffle support 24 (whether the containment baffle means 20 includes one or more such baffle supports 24) should be configured to permit most effective use of the present invention, as described in more detail below. To provide all the features of the present invention, such configuration should permit fluid flow throughout the parts of the containment space into which the material might leak, as the separately spaced baffle supports 24 in &he embodiment described herein so permit. The ability to flow fluids throughout such parts of the containment space, without removing the baffle plate 22, is one of the features of the present invention. Such ability to flow fluids permits flushing, cleaning, and purging of the containment space with the baffle plate 22 in place.

Accordingly, therefore, the containment baffle means 20 of the particular embodiment depicted herein can be altered or modified to meet the needs of the particular tank system 10, yet still be within the scope of the present invention.

The present invention provides for including a leak detection means 50 above the bottom 14 and below the baffle plate 22. With reference now to FIG. 5, which depicts a partial cross-sectional elevational view along the line C—C of FIG. 2 (with baffle supports 24 omitted for clarity), a fiber optic probe 52 extends through the wall of the shell 12 into a space designated the containment space located above the upper surface 18 of the bottom 14 and below the bottom surface **23*b* of baffle plate 22. As shown in FIG. 5, the optic probe 52 has a probe tip 53 that extends into the containment space while the opposite end of the probe tip 53 joins a probe body 54 that extends through the shell 12 to the exterior of the tank body 11. A nipple 56 extends through a hole in the shell 12 and is secured by a circumferential weld 57 to the wall of the shell 12. The probe body 54 thus extends from the containment space in the interior of the shell 12 to the exterior of the shell 12. The welded connection provides a leak-proof seal on the exterior of the shell 12 around the outer periphery of the nipple 56. The probe body then joins a probe head 58 that contains a plurality of probe leads 60. Joining the probe leads 60 are connecting wires 62 that extend beyond the tank system 10 to an appropriate signaling, warning, process control, or other device capable of receiving and responding to signals transmitted by the fiber optic probe 52**.

The preferred embodiment shown includes the fiber optic probe 52 for use in the leak detection means 50. One acceptable fiber optic probe 52 that can achieve the purposes of the present invention, and which is generally depicted in FIG. 5, is Levelite Model 12-575 available from Arizona Instrument Company of Jerome, Ariz. The fiber optic probe 52 detects the presence of material that leaks into the containment space by emitting and detecting an optical signal. The optical signal is emitted through a prism and the fiber optic probe 52 detects the refracted optical signal. When material is introduced into the containment space, and travels or migrates to the proximity of the fiber optic probe 52, the refractive index of the prism is altered, and hence the nature of the detected optical signal changes. The fiber optic probe 52 detects such change in the optical signal and sends an electrical signal in response to detecting such change. The electrical signal can be sent, for example, to a controller device (not shown), such as Levelite Model 11-540, also available from Arizona Instrument Company of Jerome, Ariz. The combination of the fiber optic probe 52 connected to the external controller, therefore, is able to detect and react to the presence of material, particularly fluids, that may leak into the containment space.

Other devices can serve as suitable leak detection means 50, besides the fiber optic probe 52 pictured in FIG. 5. For example, for detecting the hydrostatic pressure of fluids leaked into the containment space from the interior of the tank body 11 , a suitable pressure-sensing device is Model M-3010 (Photo Helic) manufactured by Dwyer Instrument Co. of Michigan City, Ill. As another example, for detecting the presence of solids or gases within the containment space, a "sniffer" device such as Soil Sentry Twelve, available from Arizona Instrument Company of Jerome, Ariz., can be used to detect the presence of chemicals contained in certain materials in the containment space that are held in storage in the shell 12 above the baffle plate 22. Other devices would be suitable for use in the leak detection means 50 of the present invention in addition to those mentioned above, as will be apparent to those skilled in the art. For example, a float device could be installed inside the containment space to rise in the event fluid leaked into the space, and the float would send a signal in response to such rise by means of a float arm or other device, thereby serving to detect fluid leakage into the containment space and sending signals in response to such leakage. As additional examples, devices as simple as valves or sight glasses would enable visual or mechanical detection of the presence of liquids or gases in the containment space, and could thus be used in the leak detection means of the present invention.

As described in more detail below, the containment space, in normal operation, is to be empty of the material stored in the tank body 11. To purge the containment space of air or other materials that might otherwise interfere with the operation of the leak detection means 50, the present invention also includes purging the containment space with, for example, nitrogen. FIG. 6 depicts a partial cross-sectional elevational view along line D—D of FIG. 2 (with the baffle supports 24 again omitted for clarity). A fill valve 70, outside the tank, suitable for attachment to an exterior source of liquids (such as solvents or detergents) or gas (such as nitrogen) for flushing, cleaning, and purging the containment space (as described in more detail below), connects to a pipe 72 extending into a nipple 74 that is inserted and secured in a hole through the shell 12. The nipple 74 is secured to the hole in the shell 12 by a circumferential weld 78 that seals between the exterior periphery of the nipple 74 and the outside of the shell 12 to provide a leak-proof connection from the containment space inside the shell 12, through the nipple 74, through the pipe 72, and into the fill valve 70. The fill valve 70 can thus be connected to an external source of nitrogen (not shown), for example, for flushing and cleaning the containment space and for purging it of air and filling it with nitrogen. To aid in the process, with reference to FIG. 2, the embodiment depicted includes two relief valves 76A and 76B. The relief valves 76A, 76B are connected to the containment space through the shell 12 in a fashion similar to that shown in FIG. 6 for the fill valve 70. In addition, the present invention can include a plurality of valves like fill valve 70 to facilitate the flushing, cleaning, and purging process.

Referring again to FIG. 6, a primary containment means 80 is installed inside the tank body 11 within the shell 12 and above the baffle plate 22. The primary containment means 80 includes a liner 82 applied to the inside 28A of shell 12 and top side 23A of baffle plate 22. Some of the acceptable materials that are suitable for the purposes of forming the liner 82 of the present invention include phenolic, epoxy phenolic, vinyl ester, vinyl ester with glass roving, epoxy novalac, and epoxy with chopped fiberglass. As shown in FIG. 6, for abrupt changes in the interior surfaces of the tank body 11, such as where the interior of the shell 12 joins the upper surface 23A of the baffle plate 22, a layer of caulk 84 under the liner 82 provides a uniform and gradual transition over such irregular areas. Other location where such caulk 84 might be useful include the lap welds 30 shown in FIG. 3, as well as all other welded seams, bolt heads, or other projections on the interior of the tank body 11.

Figure 7:
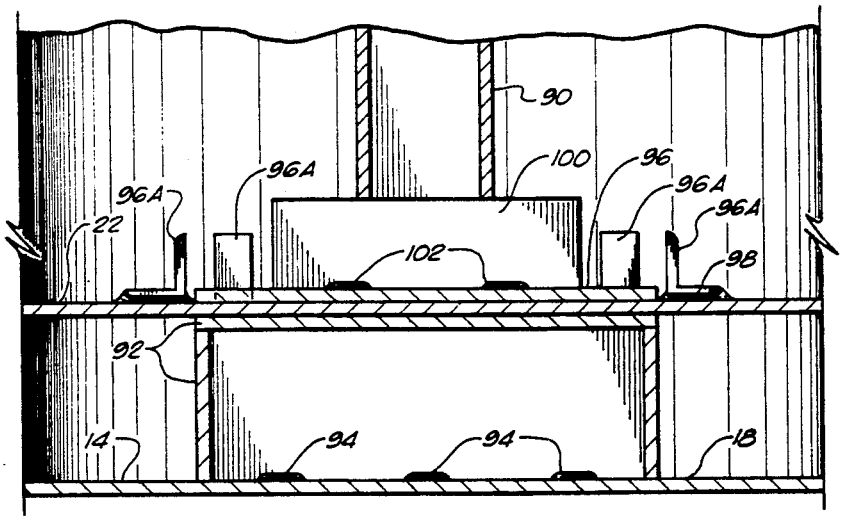
FIG. 7 shows an elevational view of a portion of a support that can be utilized in the embodiment of the tank shown in the preceding figures.
Figure 1:
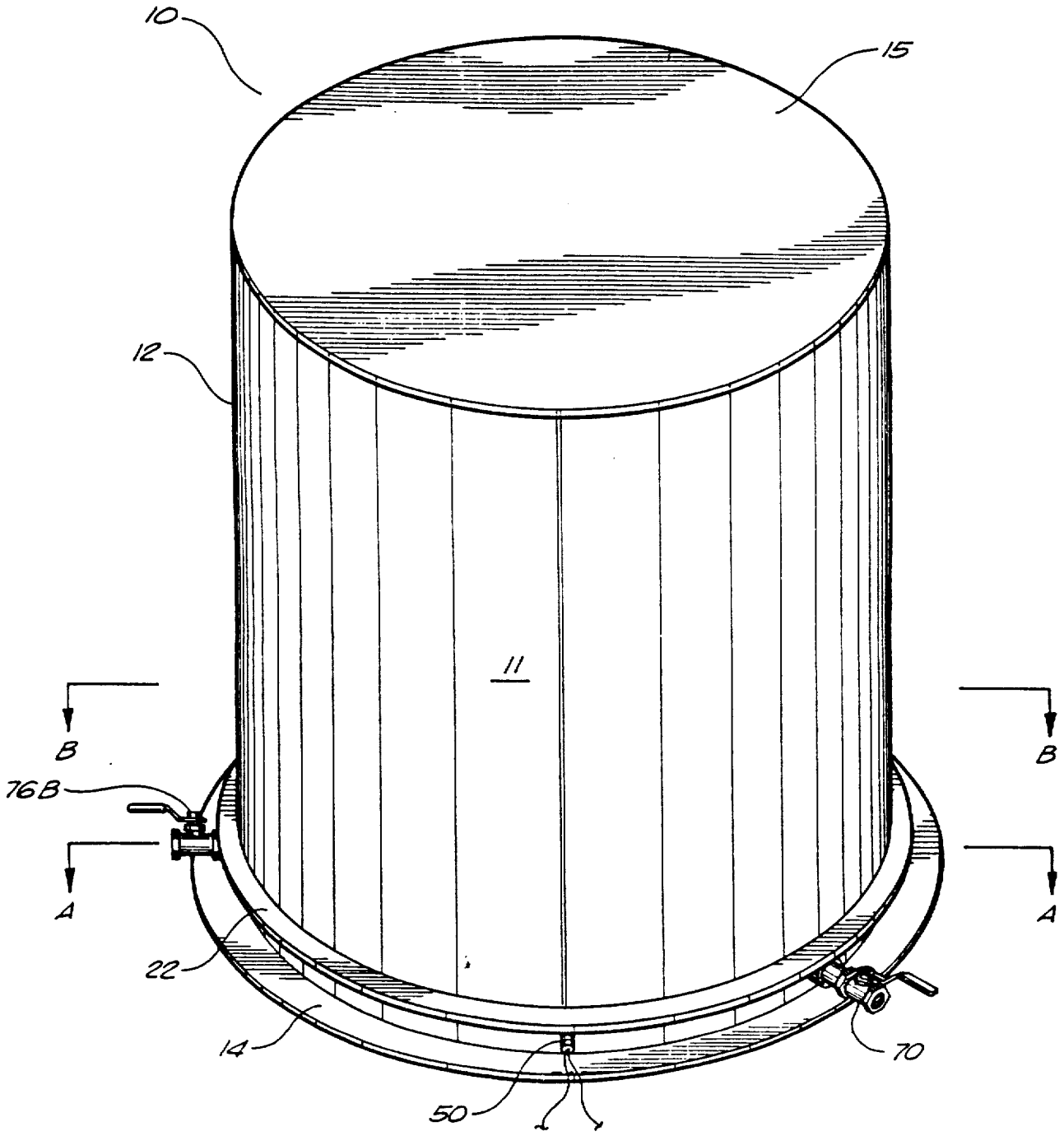

FIG. 7 depicts a portion of an optional element for use in the embodiment of the tank system 10 shown in the figures discussed above. FIG. 7 depicts a support column 90, contained within the tank body 11, used to support a roof 15 or other item such as a steam coil, piping, or other permanent fixture, contained within the tank system 10. In the absence of the present invention, a support column 90 would have at its upper end (not pictured) the item being supported, and the base of the column would rest on the bottom 14 or on a support base which in turn, would sit on the bottom 14. To install the containment baffle means 20 so as to provide a containment space below the baffle plate 22 and above the bottom 14, in accordance with the present invention, the support has to be modified as shown in FIG. 7. Accordingly, a support box 92 is installed on the upper surface 18 of the bottom 14 and secured by a plurality of support box welds 94 distributed around the periphery of the support box 92 and securing it to the upper surface 18 of the bottom 14. The baffle plate 22 rests on the upper surface of support box 92. A support base 100, in turn, rests on the baffle plate 22. The support base 100 is secured by a plurality of support welds 102 to the support plate 96. The support plate 96 rests on the top surface of baffle plate 22. The support plate 96, and associated support base 100: are maintained in position on baffle plate 22 by a plurality of guide clips 96A. Guide clips 96A are seal welded at 98 to the top surface of baffle plate 22. Each of the guide clips 96A is an L-shaped member having one surface facing the edge of support plate 96. The guide clips 96A generally surround the periphery of the guide plate 96 in a fashion that allows some deflection and movement of guide plate 96.

The support column 90 is connected to the support base 100, by welding, bolting, or otherwise securing, the support column 90 to the support base 100. The roof, or other items supported by the support column 90, therefore, rests on the support column 90, as had been the case before the installation of the present invention. In addition, and in the alternative, if the purity of the material stored in the tank system 10 is of some concern, then the support column 90 and the other components may be coated. The liner 82 will be applied to the support base 100, to the support column 90, to the support plate 96, as well as the shell 12 and the baffle plate 22.

The present invention permits installing the double containment and leak detection apparatus on new or existing tanks or vessels. The tank should be inspected and repaired to the extent necessary to ensure its pressure integrity. Before installing any baffle supports 24 or other materials on the bottom 14, the bottom 14 should be lightly sandblasted to allow for thorough inspection. If any defects are found, they should be repaired by welding any holes that are found or by welding steel plates over badly pitted areas. Then, as described above, baffle supports 24 of equal height, adequate structural strength, and appropriate length should be installed at appropriate spacing and secured to the tank bottom 14. If present, the support base 100 below the support column 90 should be cut sufficiently above the height at which the baffle plate 22 will be installed to allow for the items depicted in FIG. 7 to be installed below the bottom of the support column 90. One or more holes should then be drilled in the wall of the shell 12 to allow a nipple 56 to be inserted and welded for a leak-proof connection between the interior and exterior of the shell 12 after the fiber optic probe 52 is inserted through the nipple 56 and secure therein. As shown in FIG. 5, the holes for the nipples 56 are to be located in what will be the containment space above the bottom 14 and below the baffle plate 22. Additional holes should be drilled and nipples 74 installed, as shown in FIGS. 2 and 6, to provide for installation of the fill valve 70 and relief valves 76A, B.

Next, for an existing tank body 11, to install the baffle plate 22, slots are cut into the shell of the tank to permit portions of the baffle plate 22 to be inserted through the wall of the shell 12. As shown in FIGS. 3, 5, and 6, the portions of the baffle plate 22 extending through the wall 12 are sealingly joined to the shell by means of a baffle interior weld 28A on top of the baffle plate 22 inside the shell 12, and two baffle exterior welds 28B, C on top and bottom, respectively, of the baffle plate 22 outside the shell 12. Preferably, the baffle plate 22 outside the shell 12 should be cut and ground smooth about the circumference of the tank body 11, as shown in FIGS. 5 and 6. The individual portions that make up the complete baffle plate 22 should be laid in place and welded together with lap welds 30, as shown in FIG. 3, to form a solid, continuous sealing surface across the interior of the tank body 11 and in continuous sealing contact around the inner periphery of the shell 12. After the baffle plate 22 is installed above a support box 92, the pre-coated support plate 96 can be set in place over the support box 92 onto the upper surface 23A of the baffle plate 22. The support base 100, sized to fit over the support plate 96, is then to be installed and secured by a plurality of support base welds 102. The support base 100 and support column 90 can then be installed, by welding or otherwise.

The primary containment means 80 is then applied throughout the interior of tank body 11. As shown in FIG. 6, for example, caulk material 84 is applied to irregularities and abrupt or sharp changes in shape throughout the interior of the tank body 11, such as at the junctions of the interior of the shell 12 and the upper surface 23A of the baffle plate 22, the baffle plate 22 and the guide clips 96A, and the support plate 96 and the support base 100. Also, as noted above, in the alternative, if the entire interior of the tank system 10 is to be coated to maintain purity, the pre-coated support plate 96 can be eliminated, with the support base 100 resting directly on the baffle plate 22 and the caulk material 84 applied over the adjoining surfaces. Before applying the liner 82, all welding flux, weld splatter, sharp metal projections, and laminations should be ground smooth. Air conditioners or dehumidifiers should be used to assure that the temperature and relative humidity are suitable for the installation of the primary containment. All oil, grease, and other deleterious matter should be removed by chemical cleaning in accordance with the Structural Steel Painting Council standard SSPC-SP-1, as needed. All old surfaces to be coated with liner 82 or caulk 84 should be blast-cleaned to a white metal finish in accordance with SSPC-SP-5. The blast-cleaned surfaces should have a uniform dense anchor pattern with irregularly shaped peaks or valleys, having an overall depth of 2.5 to 3.0 mils. All dust and other foreign matters should be removed from the blast-cleaned surface by vacuum cleaning or other suitable means. The caulk 84 should then be applied to provide a uniform gradual transition on all sides of irregularly shaped or projecting surfaces, including weld seams, bolt heads, and lap joints. Total thickness of the caulk 84 should be approximately 50 mils. The appropriate liner 82 should be applied in accordance with the properly prescribed application procedure as will be readily known to those skilled in the art. Finally, the liner 82 and other coating systems applied to steel surfaces should be inspected with appropriate holiday detectors.

As described above and shown in the accompanying drawings, the present invention thus provides a double containment and leak detection system capable of satisfying EPA regulations. The liner 82 forms a primary containment system. The tank body 11, including the shell 12, the baffle plate 22, and the bottom 14, forms a secondary containment system surrounding the liner 82. This arrangement thus satisfies the requirement for a secondary containment system under the EPA regulations. In addition, the sealed containment space below the baffle plate 22 and above the bottom 14 provides for collecting and accumulating releases of materials from the primary containment means 80 within the tank body 11. The leak detection means 50 within the containment space enables rapid and effective detection of material that leaks from within the liner 82 into the containment space. The containment space, normally filled with nitrogen or some other relatively inert gas, will receive material that might leak from the primary containment means 80 and through the baffle plate 22. The leaked material will migrate throughout the containment space, facilitated by the gaps between baffle supports 24. The leak detection means 50, designed to detect whatever material is stored within the tank system 10, will immediately sense the presence of such material in its proximity within the containment space and send the appropriate signal through the connecting wires 62 to an alarm system, a control system, or some other device, thereby allowing immediate detection of leaks and thus far exceeding the 24-hour requirement for detecting leaks under the EPA regulations. Because all parts of the entire containment space are in pressure (and flow) communication, the containment space can be readily flushed and cleaned of the leaked hazardous waste, in accordance with EPA regulations. The containment space can be flushed with water, or other appropriate solvent (such as a petroleum-based solvent), which can be injected through the fill valve 70 and removed, for example, through the accesses to the containment space available at the relief valves 76A, 76B. (As noted above, additional valves could be installed in the tank system to facilitate flushing, cleaning, and purging of the containment space.) After the waste has been flushed from the containment space, a similar procedure utilizing detergent and water can be used to clean the containment space. Water can then also be flowed through to rinse the containment space. The leak area can then be repaired by conventional means. Finally, hot nitrogen or other gas can be used in similar fashion to dry the containment space. After drying is complete, the containment space can again be left filled with nitrogen, thereby having been restored to its initial pre-leakage condition. Accordingly, the present invention provides apparatus capable of satisfying the EPA regulations for post-leakage cleaning of a tank system and its secondary containment system, enabling restoration to the prior operating condition.

The present invention, therefore, for both new and existing installations, provides effective means of containing and detecting leaks of hazardous materials from tank storage systems, and providing for removal of such materials and cleaning of such storage systems, while being inexpensive and relying on proven technology.

Those skilled in the art will appreciate that the foregoing list of attributes and advantages is not exhaustive of the features of the present invention. It will be appreciated that modifications to the described preferred embodiment of the invention can be made without departing from the substance and spirit of the present invention. In light of the foregoing, therefore, it will be seen that the scope of the present invention, as claimed below, exceeds that described in the preceding description of the preferred embodiment.

I claim:

1. An apparatus for holding a stored liquid and for containing and detecting leaks of such liquid comprising:

(a) A tank, including a tank bottom having a continuous surface for supporting such store liquid, and further including a shell for surrounding such stored liquid, said shell being disposed above said continuous surface of said tank bottom and in continuous sealing contact therewith;

(b) Containment baffle means, including (i) a baffle plate having a continuous rigid surface for supporting such stored liquid, said baffle plate being disposed above said tank bottom and within said shell, and said continuous surface of said baffle plate being in continuous sealing contact with said shell, thereby forming a containment space disposed between said baffle plate and said tank bottom; and (ii) wherein said baffle plate is rigidly supported above said tank bottom and such containment space is sufficiently free of obstructions to liquid flow to permit said liquid to be flushed from such containment space while said baffle plate remains in place, said containment space being generally unpressurized, said containment baffle means includes a baffle support, located in such containment space, which depends upon said tank and supports said baffle plate, said baffle support is a rigid structural member configured to permit liquid flow through such containment space, said baffle support affixed to said tank bottom and extending upwardly therefrom, said baffle support in abutment with said baffle plate; and (c) Leak detection means for detecting and sending signals in response to the presence of such stored liquid within said containment space, said leak detection means directly interactive with such stored liquid in said containment space.

2. The apparatus of claim 1, and further comprising a primary containment means, located within said tank above said containment baffle means and within said shell, capable of containing such store liquid.

3. The apparatus of claim 2, wherein said primary containment means includes a liner disposed inside said shell.

4. The apparatus of claim 1, wherein said leak detection means extends through said shell into said containment space, said leak detection means is connected to a device external to said tank for receiving and responding to signals from said leak detection means.

5. The apparatus of claim 1, wherein said leak detection means includes a fiber optic probe.

6. The apparatus of claim 1, wherein said leak detection means includes a device for sensing hydrostatic pressure.

7. The apparatus of claim 1, wherein said leak detection means includes a device for detecting the presence of a predetermined substance.

8. The apparatus of claim 1 further comprising means for flushing such stored liquid from such containment space.

9. The apparatus of claim 8, wherein said flushing means includes piping penetrating said shell and sealingly joined thereto, to provide a channel for fluid flow between such containment space and space exterior to said shell.

10. The apparatus of claim 1, wherein a plurality of said baffle supports are disposed within such containment space and separated by gaps of sufficient size between adjacent said baffle supports to permit fluid flow therebetween.

* * * * *

UNITED STATES PATENT AND TRADEMARK OFFICE

CERTIFICATE OF CORRECTION

PATENT NO. : 5,096,087

DATED : March 17, 1992

INVENTOR(S) : Horace F. Thomas

It is certified that error appears in the above-indentified patent and that said Letters Patent is hereby corrected as shown below:

The sheet of drawing consisting of Figs. 1 and 3 should be deleted to be replaced with the sheet of drawing consisting of Fig. 1, as shown on the attached page.

Signed and Sealed this

Seventh Day of September, 1993

Bruce Lehman

*Attest:*

BRUCE LEHMAN

*Attesting Officer*

*Commissioner of Patents and Trademarks*